US005230994A

United States Patent [19]

Yamada et al.

[11] Patent Number: 5,230,994

[45] Date of Patent: Jul. 27, 1993

[54] SILVER HALIDE PHOTOGRAPHIC MATERIAL

[75] Inventors: Sumito Yamada; Tetsuo Nakamura, both of Kanagawa, Japan

[73] Assignee: Fuji Photo Film Co., Ltd., Kanagawa, Japan

[21] Appl. No.: 764,608

[22] Filed: Sep. 20, 1991

[30] Foreign Application Priority Data

Sep. 20, 1990 [JP] Japan ..... 2-251191

[51] Int. Cl.[5] ..... G03C 1/76

[52] U.S. Cl. ..... 430/539; 430/567; 430/930; 430/963

[58] Field of Search ..... 430/539, 567, 930, 963

[56] References Cited

U.S. PATENT DOCUMENTS 4,414,304 11/1983 Dickerson ..... 430/567
4,847,189 7/1989 Suzuki et al. ..... 430/567
5,066,569 11/1991 Nagashima et al. ..... 430/567
5,098,818 3/1992 Ito et al. ..... 430/963

FOREIGN PATENT DOCUMENTS 0239363 9/1987 European Pat. Off. .
0248390 12/1987 European Pat. Off. .
0267019 5/1988 European Pat. Off. .

*Primary Examiner*—Charles L. Bowers, Jr.
*Assistant Examiner*—Thomas R. Neville
*Attorney, Agent, or Firm*—Sughrue, Mion, Zinn, Macpeak & Seas

[57] ABSTRACT

A silver halide photographic light-sensitive material suitable for super rapid processing in not more than 60 seconds is disclosed, which comprises a transparent support having coated thereon gelatin in a total coating amount of 1.7–2.5 g/m$^2$ per one side of the support and a photosensitive layer containing photosensitive silver halide grains, the silver halide grains being silver iodobromide having a silver iodide content of not more than 0.6 mol%.

2 Claims, No Drawings

SILVER HALIDE PHOTOGRAPHIC MATERIAL

FIELD OF THE INVENTION

The present invention relates to a silver halide photographic material which can cope with a rapid processing to develop images having excellent properties such as dryness, fixability and washability so that it makes a remarkable improvement on the level of roller mark developed during the course of processing with an automatic processing machine. More particularly, it relates to a photographic material which is particularly suitable for such a super rapid processing as "Dry to Dry" in not more than 60 seconds.

BACKGROUND OF THE INVENTION

Recently, high temperature rapid development has been used widely as a development process for photographic materials and an improvement in substantially shortening processing time with an automatic processing machine has been achieved for a variety of photographic materials. To secure rapid processing, it is necessary to take the following into account: a developer for attaining such an activity so as to obtain a satisfactory sensitivity in a short time; a photographic material which develops images having an excellent development activity in progress to provide a satisfactory density in a short time; and characteristics of obtaining satisfactory dryness in a short time after washing.

As a widely recognized method for improving the dryness of a photographic material, there is a known method wherein a hardening agent (gelatin cross-linking agent) is added preliminarily during the course of a coating process of a photographic material in an amount sufficient to provide a reduced level of swelling of emulsion layers and hydrophilic colloid layers during the course of the development-fixing-washing processes so that the water content of the photographic material before commencement of drying is reduced. The method suffers from the disadvantages that although drying time is reduced there is an increase in the amount of hardening agent. Furthermore, the swelling level is smaller resulting in a retardation in development. The result is decreased sensitivity as well as a sort gradation. The method provides further disadvantages that, even if the development activity in progress of a photographic material is improved, the retardation of fixing rate due to a high degree of hardening brings about problems with residual silver, residual hypo or residual dye in the photographic material, thus placing obstacles in reducing processing time of the photographic material.

Moreover, methods also have been known for raising the developing activity of a developer wherein a developing agent or an auxiliary developing agent is added in increased amounts thereof; the pH of a developer is increased; or the temperature of processing is raised. However, the methods suffer from disadvantages that the preservability of a developer is impaired; and, even if an increase in sensitivity is achieved, the photographic material tends to undergo soft gradation as well as fogging.

To surmount the above-described disadvantages encountered therein, methods using tabular grains have been disclosed in U.S. Pat. Nos. 4,439,520 and 4,425,425. Also, methods for improving development activity in progress and the sensitivity/fogging ratio of a photographic material by controlling the site of initiating development in silver halide grains having planes (111) to produce sites at the top or along the edges, or in the vicinity thereof, have been known, as disclosed in JP-A-63-305343 and JP-A-1-77047 (the term "JP-A" as used herein means an "unexamined published Japanese patent application). Moreover, JP-A-58-111933 disclosed a photographic element for use in radiography which comprises using tabular grains for giving a swelling ratio of a hydrophilic colloid layer of not more than 200%, thus resulting in high covering power without requiring an additional hardening on processing.

Each of the known methods is a valuable technique for improving the development activity in progress of a photographic material. However, with the processing time of each step involved therein being reduced during the course of development, fixing and washing processes in the methods, there are further disadvantages such as a degraded fixability and a decreased sensitivity which causes an undesirable deterioration in both residual silver and residual hypo. Also, where the photographic material is subjected to spectral sensitization using sensitizing dyes, a problem of residual dyes arises. Even if an attempt to solve those problems, other than photographability, is made by means of improving the properties of silver halide grains, inherently there are limited levels of improvement, resulting finally in a problem of hardening. That is to say, the thickness of a hydrophilic colloid layer determines the attained degree of fixing and residual dye thus constituting obstacles in the goal of rapid processing.

With respect to that point, in order to accomplish a super rapid processing exhibiting a total processing time of not less than 20 to less than 60 seconds, methods have been disclosed wherein gelatin is used on the side of hydrophilic colloid layers including a silver halide emulsion layer in the amount of from 2.00 to 3.50 g/m2 The gelatin is combined with other technical elements as described in, e.g., JP-A-64-73333, JP-A-64-86133, JP-A-1-105244, JP-A-1-158435 and JP-A-1-158436. Also, JP-A-2-68537 discloses that a super rapid processing can be accomplished by preparing an emulsion layer using gelatin controlled in a ratio of silver to gelatin of not less than 1.5 (silver/ gelatin by weight) in the photosensitive silver halide emulsion layer. Moreover, JP-A-63-221341 discloses that silver halide grains in an emulsion layer comprise mainly tabular grains having a ratio of grain diameter to grain thickness of not less than 5 and gelatin is present in an amount of 2.00 to 3.20 g/m2, with melting time being adjusted in the range of not less than 8 to not more than 45 minutes, to accomplish a super rapid processing exhibiting a total processing time of not less than 20 to less than 60 seconds.

The prior art such as those described above has been studied. As a result, it has been confirmed that the prior art still is insufficient in accomplishing super rapid processing in the commercially available techniques because of the disadvantages that, as a reduced amount of gelatin is used or an enhanced ratio of silver/gelatin is used while keeping the amount of silver coated constant, both abrasion blackening and roller mark become more serious, finally resulting in practically unallowable levels.

The term, "abrasion blackening", as used herein means a darkening phenomenon in which an abrasion-like blackening is formed after development where films are rubbed against each other or a film is rubbed with some other substances while being handled. The term, "roller mark", as used herein means a darkening phenomenon in which an unevenly darkened spot formed by the different pressures applied onto photographic materials due to the uneven surface of the carrying roller while the photographic material is processed with an automatic processing machine.

There are disadvantages in dryness, particularly when an automatic processing machine is used in an environment with high humidity unless the amount of gelatin coated is not more than 2.5 g/m$^2$, as a result of the fact that running time is distributed suitably in the development, fixing and washing steps when the processing is carried out for period of a total processing time of not more than 60 seconds, particularly of not more than 40 seconds for setting.

Methods of improving such abrasions and roller marks in the amount of gelatin coated of not more than 2.5 g/m$^2$ have been studied. As a result, it has been found that any reduction in the amount of silver iodide contained in a silver halide emulsion is useful in part for solving the problem. JP-A-63-221341 discloses that, where silver halide grains are formed, tabular grains having a silver iodide content of 0.57 mol% are used, followed by a gold-sulfur sensitization: After sensitization, potassium iodide is added in an amount of 0.1 mol% to provide a total of silver iodide content of 0.67 mol%. Such a sample with 2.5 g/m$^2$ of gelatin coated has been evaluated in terms of the performance of roller mark. The results were found to be on an insufficient level.

There also has been no problem in dryness due to the sufficient hardening since the gelatin coated is present in the amount of 2.87 g/m$^2$ as in the example of the tabular grains as described in JP-A-58-111933. However, it has been found, in that case, that there remain problems in fixability and residual dye when the total processing time is set for 40 seconds or less.

JP-A-2-68537 discloses an embodiment in which gelatin is used in an amount of 2.5 g/m$^2$ per one side of coating and silver chlorobromide or silver bromide is used without containing silver iodide. However, it has been found that silver chlorobromide or silver bromide shows considerably reduced sensitivity as compared with that of silver iodobromide in a low content of solver iodide.

SUMMARY OF THE INVENTION

An object of the present invention is to provide a photographic material which gives image quality, even when being subjected to a super rapid processing, exhibiting a high level in sensitivity without causing disadvantages in dryness, fixability and residual dye and also exhibiting a practically sufficient level in roller mark.

The above object of the present invention is accomplished by a photographic material described below.

(1) A silver halide photographic light-sensitive material comprising a transparent support having coated thereon gelatin in a total coating amount of 1.7–2.5 g/m$^2$ per one side of the support and a photosensitive layer containing photosensitive silver halide grains said silver halide grains being silver iodobromide having a silver iodide content of not more than 0.6 mol%.

(2) A silver halide photographic light-sensitive material comprising a transparent support having coated thereon gelatin in a total coating amount of 1.7–2.5 g/m$^2$ per one side of the support and one ore more hydrophilic colloid layers at least one of which is a photosensitive layer containing photosensitive silver halide grains, said silver halide grains being silver iodobromide having a silver iodide content of not more than 0.6 mol% and and a swelling ratio determined by freeze-drying of said hydrophilic colloid layer(s) being 200–280%.

(3) The silver halide photographic light-sensitive material as described in (1) or (2) above, wherein at least 70% of said silver halide grains expressed in terms of a projected area are tabular grains having an aspect ratio of 3 or more.

DETAILED DESCRIPTION OF THE INVENTION

The photographic material of the present invention may comprise a support having at least one silver halide photosensitive emulsion layer provided on one side of the support or may comprise a support having at least one silver halide photosensitive emulsion layer provided on each of both sides of the support.

The photographic material of the present invention may have, if desired, in addition to a photosensitive silver halide emulsion layer, another hydrophilic colloid layer, for example, preferably a protective layer. The photographic material of the present invention comprises a support coated with gelatin of a hydrophilic colloid layer or layers including a photosensitive silver halide emulsion layer in an amount of from 1.70 to 2.50 g/m$^2$ per one side of the support. When the photosensitive emulsion layer is present only on one side of a support, it is necessary that gelatin on that side is present in the range described above, while when the photosensitive emulsion layers are present on both sides of the support, it is necessary that gelatin on both sides each is present in the range described above. Where the photosensitive emulsion layer is present while other hydrophilic colloid layers are absent, it follows that gelatin in the photosensitive emulsion layer is present in the range described above.

Such being so, gelatin is present more preferably in an amount of from 1.80 to 2.4 g/m$^2$, particularly preferably from 1.9 to 2.3 g/m$^2$, per one side. In the photographic materials of the present invention, the melting time may be preferably from 8 to 45 minutes for setting.

The term "melting time" as used in the present specification is defined as follows: A silver halide photographic material is cut into a sheet having a size of 1 cm$\times$2 cm. When the sheet is immersed in a solution of 1.5% by weight sodium hydroxide at 50° C., at least one of the silver halide emulsion layers constituting the silver halide photographic material begins to melt. The melting time means the period of time elapsed before it begins to melt.

The grains of the emulsion which are used in the present invention are described below.

The average grain size expressed in terms of the diameter of the grains of an equivalent volume sphere may be preferably 0.4 $\mu$m or more, particularly preferably from 0.5 to 2.0 $\mu$m. It is preferred to use a narrow grain size distribution of the grains in the emulsion of the present invention.

The silver halide grains in the emulsion may have a regular crystal form such as cubic, octahedral etc., or an irregular crystal form such as spherical, tabular, potato-like etc., or a mixture of grains having various crystal forms may be used.

As the composition of silver halide for use in the present invention, silver iodobromide preferably is used because it is high in sensitivity.

The silver halide grains of the present invention may be required to have a silver iodide content, expressed in terms of the average value of grains each per the total amount of silver, of not more than 0.6 mol%, preferably from 0.001 to 0.5 mol%, particularly preferably from 0.01 to 0.4 mol%. The silver iodide in the individual grains of the present invention may be either distributed non-uniformly or distributed uniformly throughout the individual grains.

The silver halide grains of the present invention may contain, such a trace amount of silver iodide as to have no effect upon photographability thereof, and more preferably no silver iodide.

When a monodispersed emulsion is used, as the emulsion in embodying the present invention, the monodispersed emulsion may be prepared preferably in such a way that a water-soluble silver salt and a water-soluble halide are added in an increased addition rate as the precipitated silver halide grains grow. The addition rate is accelerated, thus resulting in that the grain size distribution is made monodispersed and the reduced period of mixing time is obtained such that the industrial productivity can be improved. Further, the preferred results also are obtained in view of the reduced possibility of forming a structural defect in inside the grains. The method for accelerating the addition rate may comprise accelerating the addition rate of a water-soluble silver salt as well as that of a water-soluble halide either continuously or in stepwise fashion as described in JP-B-48-36890 and JP-B-52-16364 and in JP-A-55-142329 (the term "JP-B" as used herein means an examined Japanese patent publication"). The upper limit of the above addition rate may be a rate at which the system is on the verge of forming the new additional grains and the value of the upper limit varies depending upon conditions such as temperature, pH, pAg, the level of stirring, the composition of silver halide grains, solubility, grain size, distance between grains or kind or concentration of protective colloid.

The method for preparing a monodispersed emulsion is known, as described in J. Photo. Sci., 12, 242–251 (1963), JP-B-48-36890, JP-B-52-16364 and JP-A-55-142329, and the method as described in JP-A-57-179835 may be employed in the present invention.

The silver halide emulsion which is used in the present invention may be the monodispersed emulsion of a core/shell type which is known, as described in JP-A-54-48521.

When a polydispersed emulsion is used as the emulsion in embodying the present invention, the polydispersed emulsion may be prepared using a known method, for example, as described in T. H. James, "The Theory of the Photographic Process", 4th edition, page 38–104, Macmillan Pub. (1977), such as a neutral process, acid process, ammonia process, normal mixing process, reverse mixing process, double jet process, controlled double jet process, conversion process or core/shell process.

Tabular grains having a diameter/thickness ratio of at least 5 preferably can be used in the present invention, as described in detail in Research Disclosure, Vol. 225, Item 22534, page 20–58, January 1983, JP-A-58-127921 and JP-A-58-113926. The tabular silver halide grains can be prepared by suitably combining methods known for those skilled in the art.

The tabular silver halide emulsion is described in Cugnac and Chateau, "Evolution of the morphology of silver bromide crystals during physical ripening", Science et Industrie Photographic, Vol. 33, No. (1962) page 121–125, Duffin, "Photographic Emulsion Chemistry", page 66–67, Focal Press, New York (1966), and A. P. H. Trivelli and W. F. Smith, Photographic Journal, Vol. 80, page 285 (1940). The tabular silver halide emulsion can be prepared with ease according to methods described in JP-A-58-127921, JP-A-58-113927 and JP-A-58-113928 and in U.S. Pat. No. 4,439,520.

In order to make advantageous use of the effect of the present invention, it is preferred that a silver halide-adsorbing substance be present in an amount of not less than 0.5 mmol per mol of silver halide in chemical sensitization during the course of preparing an emulsion as described in JP-A-2-68539. The addition of a silver halide-adsorbing substance can be made at any stage such as during or immediately after the formation of grains and before or after the beginning of post-ripening, but preferably before or at the same time as the addition of a chemical sensitizer such as a gold or sulfur sensitizer; however, it is at best necessary that the silver halide-adsorbing substance be present during the course of chemical sensitization.

The addition of a silver halide-adsorbing substance can be carried out under conditions such as, at a given temperature of from 30° to 80° C., but preferably from 50° to 80° C. for enhancing the adsorbability, at any value of pH or of pAg, but preferably at a pH of from 6 to 10 and at a pAg of from 7 to 9 at the time of performing the chemical sensitization.

The silver halide-adsorbing substance as used in the present invention comprises the type of a sensitizing dye or stabilizer for photographic performance.

Examples of silver halide-adsorbing substances include various compounds which are known as anti-fogging agents or stabilizers, for example, azoles (e.g., benzthiazolium salts, benzimidazolium salts, imidazoles, benzimidazoles, nitroindazoles, triazoles, benztriazoles, tetrazoles and triazines); mercapto compounds (e.g., mercaptothiazoles, mercaptobenzthiazoles, mercaptoimidazoles, mercaptobenzimidazoles, mercaptobenzoxazoles, mercaptothiadiazoles, mercaptooxadiazoles, mercaptotetrazoles, mercaptotriazoles, mercaptopyrimidines and mercaptotriazines); thio-keto compounds such as oxazolinethione; and azaindenes (e.g., triazaindenes, tetraazaindenes (particularly, 4-hydroxysubstituted (1,3,3a,7)tetraazaindenes) and pentaazaindenes).

Additional examples of silver halide-adsorbing substances which can be used in the present invention include further for example, purines, nucleic acids, or polymeric compounds as described in JP-B-61-36213 and in JP-A-59-90844. Particularly preferred are azaindenes, purines and nucleic acids in the present invention. The compounds are present in an amount of from 300 to 3000 mg, preferably from 500 to 2500 mg per mol of silver halide.

Preferred effects can be realized by using sensitizing dyes, as silver halide-adsorbing substances, in the present invention.

Examples of the sensitizing dyes include cyanine dyes, merocyanine dyes, complex cyanine dyes, complex merocyanine dyes, holopolar cyanine dyes, styryl dyes, hemicyanine dyes, oxonol dyes and hemioxonol dyes.

Useful examples of the sensitizing dyes which can be used in the present invention are described, e.g., in U.S. Pat. Nos. 3,522,052, 3,619,197, 3,713,828, 3,615,643, 3,615,632, 3,617,293, 3,628,964, 3,703, 377, 3,666,480, 3,667,960, 3,679,428, 3,672,897, 3,769,026, 3,556,800, 3,615,613, 3,615,638, 3,615,635, 3,705,809, 3,632,349, 3,677,765, 3,770,449, 3,770,440, 3,769,025, 3,745,014, 3,713,828, 3,567,458, 3,625,698, 2,526,632 and 2,503,776, in JP-A-48-76525 and in Belgian Patent 691,807. The sensitizing dye is present in an amount of not less than 300 and less than 2000 mg, preferably not less than 500 and less than 1000 mg per mol of silver halide.

Specific examples of useful sensitizing dyes in the present invention are shown below.

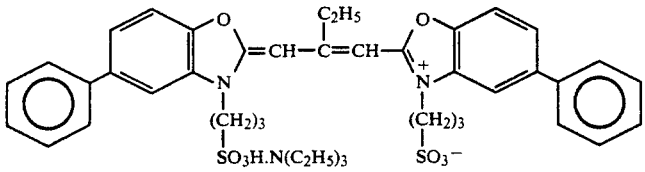

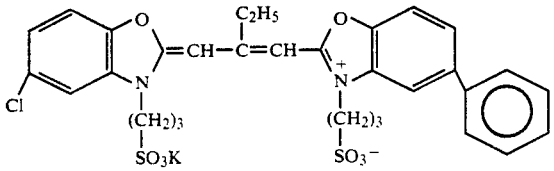

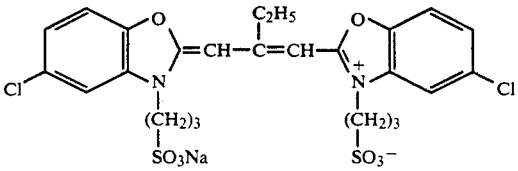

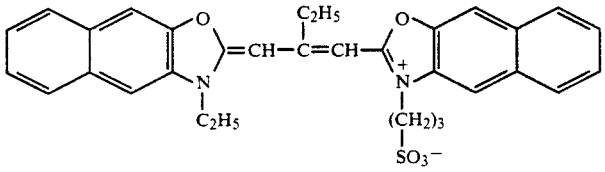

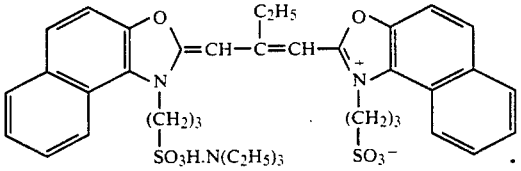

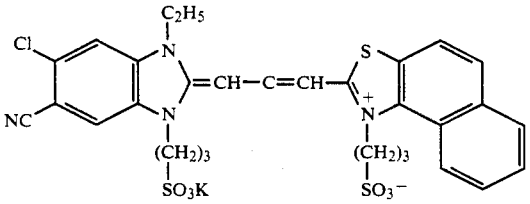

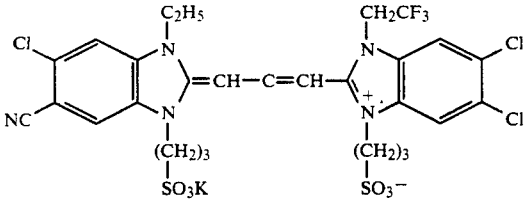

Particularly preferred are cyanine dyes.

Sensitizing dyes preferably are used in combination with the above stabilizers

Sensitizing dyes to be used in the present invention may be added thereto at any stage after a chemical sensitization step and before a coating step.

The emulsion of tabular grains to be used in the present invention is composed of grains having a diameter of 0.3 to 2.0 μm, preferably of 0.5 to 1.2 μm in projected areas of the grain. In addition, it is composed of grains having a distance between parallel planes (grain thickness) of 0.05 to 0.3 μm, preferably of 0.1 to 0.25 μm, as well as having an aspect ratio of not less than 3 and less than 20, preferably not less than 4 and less than 8. The emulsion of tabular grains to be used in the present invention is composed of grains having such a grain size distribution that grains having an aspect ratio of not less than 2 account for not less than 50%, particularly not less than 70% of the sum total of the projected area of the entire grains, preferably grains having an average aspect ratio of not less than 3, particularly of 4 to 8 account for the latter above.

Particularly preferred among tabular silver halide grains are monodispersed hexagonal tabular grains.

The structure as well as the preparation process of monodispersed hexagonal tabular grains are described in more detail in JP-A-63-151618.

The silver halide emulsions of the present invention may be subjected to chemical sensitization in the presence of silver halide-adsorbing substances. Examples of chemical sensitization include sulfur sensitization, selenium sensitization, reduction sensitization and gold sensitization. The sensitization methods may be used either alone or in combination.

Among noble metal sensitization methods, gold sensitization is a typical method. Gold compounds, particularly gold complexes, may be used. In addition to gold complexes, complex salts of other noble metals such as platinum, palladium and iridium may be used. Examples thereof are described in U.S. Pat. No. 2,448,060 and in U.K. Patent 618,061.

Examples of sulfur sensitizing agents include sulfur compounds contained in gelatin. In addition, various sulfur compounds such as thiosulfates, thioureas, thiazoles and rhodanines can be used as sulfur sensitizing agents. Examples thereof are described in U.S. Pat. Nos. 1,574,944, 2,278,947, 2,410,689, 2,728,668, 3,501,313 and 3,656,955.

A combination of sulfur sensitization by using thiosulfates and gold sensitization may be advantageously used to secure the effect of the present invention.

Examples of reduction sensitizing agents include stannous salts, amines, formamidinesulfinic acids and silane compounds.

The photographic emulsions of the present invention may contain various compounds, in addition to silver halide-adsorbing substances used in the chemical sensitization thereof, to present fogging during the production, storage or processing of the photographic materials or to stabilize photographic performance. Examples of the compounds which are known as anti-fogging agents or stabilizers include azoles (e.g., benzthiazolium salts, nitriomidazoles, nitrobenzimidazoles, chlorobenzimidazoles, bromobenzimidazoles, nitroindazoles, benztriazoles and aminotriazoles); mercapto compounds (e.g., mercaptothiazoles, mercaptobenzthiazoles, mercaptobenzimidazoles, mercaptothiadiazoles, mercaptotetrazoles and mercaptopyrimidines, mercaptotriazines); thio-keto compounds such as oxazolinethione; azaindenes (e.g., triazaindenes, tetrazaindenes (particularly, 4-hydroxy-substituted (1,3,3a,7)tetraazaindenes) and pentaazaindenes); benzenethiosulfonic acid, benzenesulfinic acid and benzenesulfonaimde.

Particularly preferred examples of the compounds are nitron and derivatives thereof described in JP-A-60-76743 and JP-A-60-87322; mercapto compounds described in JP-A-60-80839; and heterocyclic compounds and complex salt of heterocyclic compounds with silver (e.g., 1-phenyl-5-mercaptotetrazole silver). When sensitizing dyes are used as silver halide-adsorbing substances in chemical sensitization, as needed, spectral sensitizing dyes in the range of other wave lengths may be used.

The photographic emulsion layers and other hydrophilic colloid layers to be prepared according to the present invention may contain various surfactants as coating aids or for the purpose of imparting antistatic properties, improving slipperiness, improving emulsifying dispersion, inhibiting adhesion and improving photographic characteristics (e.g., development acceleration, contrast, sensitization).

Examples of the surfactants include non-ionic surfactants such as saponin (steroid), alkylene oxide derivatives (e.g., polyethylene glycol, polyethylene glycol/polypropylene glycol condensate, polyethylene glycol alkyl ethers, polyethylene glycol alkyl aryl ethers and polyethylene oxide adducts of silicone) and alkyl esters of saccharide; anionic surfactants such as alkylsulfonates, alkylbenzenesulfonates, alkylnaphthalenesulfonates, alkylsulfuric esters, N-acyl-N-alkyl taurines, sulfosuccinic esters and sulfoalkylpolyoxyethylene alkyl phenyl ethers; ampholytic surfactants such as alkylbetaines and alkylsulfobetaines; and cationic surfactants such as aliphatic or aromatic quaternary ammonium salts, pyridinium salts and imidazolium salts.

Particularly preferred are saponin, anions such as the Na salt of dodecylbenzenesulfonic acid, the Na salt of di-2-ethylhexyl α-sulfosuccinic acid, the Na salt of p-octylphenoxyethoxyethanesulfonic acid, the Na salt of dodecylsulfuric acid, the Na salt of triisopropylnaphthalenesulfonic acid and the Na salt of N-methyl-oleoyltaurine; cations such as dodecyltrimethylammonium chloride, N-oleoyl-N',N',N'-trimethylammoniodiaminopropane bromide and dodecylpyridium chloride; betaines such as N-dodecyl-N,N-dimethylcarboxybetaine and N-oleoyl-N,N-dimethylsulfobutylbetaine; and nonions such as poly(average polymerization degree n=10)oxyethylene cetyl ether, poly(n=25)oxyethylene p-nonylphenol ether and bis(1-poly(n=1-5)oxyethylene-oxy-2,4-di-t-pentylphenyl)ethane.

Preferred examples of antistatic agents include fluorine-containing surfactants such as the K salt of perfluorooctanesulfonic acid, the Na salt of N-propyl-N-perfluorooctane sulfonylglycine, the Na salt of N-propyl-N-perfluorooctanesulfonylaminoethyloxypoly(n=3)oxyethylenebutanesulfonic acid, N-perfluorooctanesulfonyl-N',N',N'-trimethylammoniodiaminopropane chloride and N-perfluorodecanoylaminopropyl-N',N-dimethyl-N'-carboxybetaine, nonionic surfactants described in JP-A-60-80848, JP-A-61-112144, JP-A-62-172343 and JP-A-62-173459, alkali metal nitrates, electrically conductive tin oxide, zinc oxide and vanadium pentoxide, and the composite oxides doped with antimony etc.

Examples of matting agents which can be used in the present invention include, as described in U.S. Pat. Nos. 2,992,101, 2,701,245, 4,142,894 and 4,396,706, organic compounds such as homopolymers (e.g., polymethyl methacrylate), copolymers (e.g., copolymer of methyl methacrylate with methacrylic acid) and starch, and fine particles of inorganic compounds such as silica, titanium dioxide and sulfates of strontium and barium. The particle size thereof is preferably 1.0 to 10 μm, particularly preferably 2 to 5 μm.

Examples of slip agents which can be used in the surface layers of the photographic materials of the present invention include the silicone compounds described in U.S. Pat. Nos. 3,489,576 and 4,047,958, colloidal silica as described in JP-B-56-23139, paraffin wax, higher fatty acid esters and starch derivatives.

The hydrophilic colloid layers of the photographic materials of the present invention may contain, as plasticizers, polyols such as trimethylol propane, pentanediol, butanediol, ethylene glycol and glycerine.

The emulsion layers, intermediate layers and surface protective layers of the photographic materials of the present invention can contain, as a binder or protective colloid, gelatin advantageously, but other hydrophilic colloids may be used. Examples thereof include proteins such as gelatin derivatives, graft polymer of gelatin with other polymers, albumin and casein; cellulose derivatives such as hydroxyethyl cellulose, carboxymethyl cellulose and cellulose sulfuric esters and saccharide derivatives such as sodium alginate, dextran and starch derivatives; and synthetic hydrophilic high-molecular materials, i.e., homopolymers such as polyvinyl alcohol, polyvinyl alcohol partial acetal, poly-N-vinylpyrrolidone, poylacrylic acid, polymethacrylic acid, polyacrylamide, polyvinylimidazole and polyvinylpyrazole and copolymers thereof.

Examples of gelatin include lime-processed gelatin, acid-processed gelatin and enzyme-processed gelatin. The hydrolyzates or enzyme degradation products of gelatin also can be used.

Among them, it is preferred to use gelatin, in combination with dextran or polyacrylamide, having an average molecular weight of not more than 50,000. Methods described in JP-A-63-68837 and JP-A-63-149641 can be used advantageously in the present invention.

The photographic emulsion layers and non-photosensitive hydrophilic colloid layers of the present invention may contain inorganic or organic hardening agents. Suitable examples of the hardening agents include chromium salts (e.g., chromium alum and chromium acetate), aldehydes (e.g., formaldehyde, glyoxal and glutaraldehyde), N-methylol compounds (e.g., dimethol urea and methylol dimethylhydantion), dioxane derivatives (e.g., 2,3-dihydroxydioxane), active vinyl compounds (e.g., 1,3,5-triacryloyl-haxahydro-s-triazine, bis(vinylsulfonyl)methyl ether and N,N'-methylenebis[β-(vinylsulfonyl)propionamide]), active halogen compounds (e.g., 2,4-dichloro-6-hydroxy-s-triazine), mucohalogenic acids (e.g., mucochloric acid and mucophenoxychloric acid), isoxazoles, dialdehydostarch and 2-choro-6-hydroxytriazine-treated gelatin. The compounds may be used either alone or in combination. Preferred are the active vinyl compounds described in JP-A-53-41221, JP-A-53-57257, JP-A-59-162546 and JP-A-60-80846 and the active halogen compounds described in U.S. Pat. No. 3,325,287.

Polymeric hardening agents can also be advantageously used as a hardening agent in the present invention. Examples of polymeric hardening agents which can be used in the present invention include dialdehydostarch, polyacrolein, aldehyde group-containing polymers such as acrolein copolymers described in U.S. Pat. No. 3,396,029, epoxy group-containing polymers described in U.S. Pat. No. 3,623,878, dichlorotriazine group-containing polymers described in U.S. Pat. No. 3,362,827 and Research Disclosure, No. 17333 (1978), active ester group-containing polymers described in JP-A-56-66841, active vinyl group or its precursor group-containing polymers described in U.S. Pat. No. 4,161,407, in JP-A-56-142524 and JP-A-54-65033 and in Research Disclosure No. 16725 (1978). The polymers containing active vinyl group or its precursor are preferred. Particularly preferred of such polymers are the polymers described in JP-A-56-142524 wherein the active vinyl group or its precursor is linked to the polymeric main chain by a long spacer.

The hydrophilic colloid layers of the photographic materials of present invention are preferably hardened to such an extent as to give a swelling ratio of not more than 280%, particularly of 200 to 280% in water.

The swelling ratio in water of the hydrophilic colloid layers of the photographic materials in the present invention is measured using freeze drying. The swelling ratio of hydrophilic colloid layers is determined after a photographic material sample is allowed to stand for 7 days under the conditions of 25° C. and 60% RH. A dry thickness (a) is measured by testing a slice of a sample in a scanning electron microscope. The photographic material sample is immersed in distilled water at 21° C. for 3 minutes and subsequently it is freeze dried by liquid nitrogen. The thus prepared specimen is tested in a scanning electron microscope to determine a swollen film layer size (b). Thus, a swelling ratio is obtained by the equation: $(b)-(a)/(a)\times 100(\%)$.

As a support polyethylene terephthalate films or triacetyl cellulose films preferably may be used.

For improving adhesion between a support and a hydrophilic colloid layer, the surface of a support preferably may be subjected to pretreatment such as corona discharge, glow discharge and ultraviolet irradiation. Alternatively, it may be provided with a subbing layer comprising lattices such as styrenebutadiene bases and vinylidene chloride-based lattice. Furthermore, an additional gelatin layer may be formed thereon.

Also, another subbing layer may be provided using an organic solvent containing a polyethylene swelling agent and gelatin. Surface treatment may be applied to the subbing layers to improve adhesion to the hydrophilic colloid layer.

The emulsion layers of the photographic materials of the present invention may contain plasticizers such as polymers and emulsions to improve pressure characteristics. Disclosed examples of such added plasticizers include heterocyclic compounds described in Brit. Patent 738,618, alkyl phthalates described in Brit. Patent 738,637, alkyl esters described in Brit. Patent 738,639, polyvalent alcohol described in U.S. Pat. No. 2,960,404, carboxyalkyl cellulose described in U.S. Pat. No. 3,121,060, paraffins and carboxylates described in JP-A-49-5017 and alkyl acrylates and organic acids described in JP-B-53-28086.

Other compositions in the emulsion layers of the silver halide photographic materials of the present invention may be used and not particularly limited; as needed, various additives may be incorporated thereinto. Examples of such additives include binders, surfactants, other dyes, ultraviolet absorbents, coating aids, viscosity imparting agents and others.

The present invention is now illustrated in greater detail by way of the following Examples, but it should be understood that the present invention is not deemed to be limited thereto. Unless otherwise indicated therein, all parts, percents, ratios and the like are by weight.

EXAMPLE 1

Preparation of Octahedral Grain A-1 for Comparative Example

Added simultaneously to a solution of 0.35 g of potassium bromide and 20.6 g of gelatin in one liter of water, keeping the solution at a temperature of 50° C. with stirring, were 40 ml of an aqueous solution of 0.28 g of silver nitrate and 40 ml of an aqueous solution of 0.21 g of potassium bromide over a period of 10 minutes by a double jet process. Subsequently, added simultaneously thereto were 200 ml of an aqueous solution of 1.42 g of silver nitrate and 200 ml of an aqueous solution of 1.06 g of potassium bromide over a period of 8 minutes. Further, 27 ml of an aqueous solution containing 2.7 g of potassium bromide was added thereto. Subsequently, an aqueous solution of silver nitrate and an aqueous solution of potassium bromide were added thereto by a controlled double jet process. The addition of one liter of an aqueous solution of 140 g of silver nitrate was made at such a linearly accelerating rate that the flow rate at the time of the commencement of the addition was 2 ml/minute and the addition was completed over a period of 70 minutes. An aqueous solution of potassium bromide was added simultaneously thereto while keeping the controlled potential at a pAg of 8.58.

After completion of the addition, the temperature of the mixture was lowered to 35° C. and soluble salts were removed by a precipitation method. The temperature thereof again was raised to 40° C. and then 30 g of gelatin, 2.35 g of phenoxyethanol and 0.8 g of sodium polystyrene sulfonate as a thickening agent were added thereto. The pH of the mixture was adjusted to 6.0 by using caustic soda.

Thus, the resulting emulsion was composed of monodispersed pure silver bromide octahedral grains A-1 having an average particle size of 0.62 μm.

Preparation of Octahedral Grain A-2 for the Present Invention

Added simultaneously to a solution of 0.35 g of potassium bromide and 20.6 g of gelatin in one liter of water, keeping the solution st a temperature of 50° C. with stirring, were 40 ml of an aqueous solution of 0.28 g of silver nitrate and 40 ml of an aqueous solution of 0.21 g of potassium bromide over a period of 10 minutes by a double jet process. Subsequently, added simultaneously thereto were 200 ml of an aqueous solution of 1.42 g of silver nitrate and 200 ml of an aqueous solution of 1.06 g of potassium bromide over a period of 8 minutes. Further, 27 ml of an aqueous solution containing 2.7 g of potassium bromide were added thereto. Subsequently, an aqueous solution of silver nitrate and an aqueous solution of potassium bromide were added thereto by a controlled double jet process. The addition of one liter of an aqueous solution of 140 g of silver nitrate was made at such a linearly accelerating rate that the flow rate at the time of the commencement of the addition was 2 ml/minute and the addition was completed over a period of 70 minutes. An aqueous solution of potassium bromide was added simultaneously thereto while keeping the controlled potential at a pAg of 8.58. (So far, the procedure was the same as that of the above A-1.) Subsequently, a 1% aqueous solution of potassium iodide was added thereto in an amount of 0.1 mol% based on the total weight of silver over a period of one minute.

After completion of the addition, the temperature of the mixture was lowered to 35° C. and soluble salts were removed by a precipitation method. The temperature thereof was again raised to 40° C. and 30 g of gelatin, 2.35 g of phenoxyethanol and 0.8 g of sodium polystyrene sulfonate as thickening agent were added thereto. The pH of the mixture was adjusted to 6.0 by using caustic soda.

Thus, the resulting emulsion was composed of monodispersed silver iodobromide octahedral grains A-2 having an average particle size of 0.62 μm and a silver iodide content of 0.1 mol%.

Preparation of Octahedral Grain A-3 for the Present Invention

Added simultaneously to a solution of 0.35 g of potassium bromide and 20.6 g of gelatin in one liter of water, keeping the solution at temperature of 50° C. with stirring, were 40 ml of an aqueous solution of 0.28 g of silver nitrate and 40 ml of an aqueous solution of 0.21 g of potassium bromide over a period of 10 minutes by a double jet process. Subsequently, added simultaneously thereto were 200 ml of an aqueous solution of 1.42 g of silver nitrate and 200 ml of an aqueous solution of 1.06 g of potassium bromide over a period of 8 minutes. Further, 27 ml of an aqueous solution containing 2.7 g of potassium bromide were added thereto. (So far, the procedure was the same as that of A-1 or A-2 above.)

Subsequently, an aqueous solution of silver nitrate and an aqueous solution of a mixture of potassium bromide and potassium iodide were added thereto by a controlled double jet process. The addition of one liter of an aqueous solution of 140 g of silver nitrate was made at such a linearly accelerating rate that the flow rate at the time of the commencement of the addition was 2 ml/minute and the addition was completed over a period of 70 minutes. An aqueous solution of a mixture of potassium bromide and potassium iodide was added simultaneously thereto while keeping the controlled potential at a pAg of 8.58.

At that moment an amount of 0.4 mol% of potassium iodide, based on the total weight of silver, was consumed. Furthermore, a 1% aqueous solution of potassium iodide was added thereto in an amount of 0.1 mol% based on the total weight of silver, over a period of a minute.

After completion of the addition, the temperature of the mixture was lowered to 35° C. and soluble salts were removed by a precipitation method. The temperature thereof was again raised to 40° C. and 30 g of gelatin, 2.35 g of phenoxyethanol and 0.8 g of sodium polystyrene sulfonate as a thickening agent were added thereto. The pH of the mixture was adjusted to 6.0 by using caustic soda.

Thus, the resulting emulsion was composed of monodispersed silver iodobromide octahedral grains A-3 having an average particle size of 0.63 μm and a silver iodide content of 0.5 mol%.

Preparation of Octahedral Grain A-4 for Comparative Example

Added simultaneously to a solution of 0.35 g of potassium bromide and 20.6 g of gelatin in one liter of water, keeping the solution at a temperature of 50° C. with stirring, were 40 ml of an aqueous solution of 0.28 g of silver nitrate and 40 ml of an aqueous solution of 0.21 g of potassium bromide over a period of 10 minutes by a double jet process. Subsequently, added simultaneously thereto were 200 ml of an aqueous solution of 1.42 g of silver nitrate and 200 ml of an aqueous solution of 1.06 g of potassium bromide over a period of 8 minutes. Further, 27 ml of an aqueous solution containing 2.7 g of potassium bromide was added thereto (So far, the procedure was the same as that of A-1, A-2 or A-3 each above.)

Subsequently, an aqueous solution of silver nitrate and an aqueous solution of a mixture of potassium bromide and potassium iodide were added thereto by a controlled double jet process The addition of one liter of an aqueous solution of 140 g of silver nitrate was made at such a linearly accelerating rate that the flow rate at the time of the commencement of the addition was 2 ml/minute and the addition was completed over a period of 70 minutes. An aqueous solution of a mixture of potassium bromide and potassium iodide was added simultaneously thereto while keeping the controlled potential at a pAg of 8.58. At that moment an amount of 0.6 mol% of potassium iodide, based on the total weight of silver, was consumed. Furthermore, a 1% aqueous solution of potassium iodide was added thereto in an amount of 0.1 mol% based on the total weight of silver, over a period of one minute.

After completion of the addition, the temperature of the mixture was lowered to 35° C. and soluble salts were removed by a precipitation method. The temperature thereof was again raised to 40° C. and 30 g of gelatin, 2.35 g of phenoxyethanol and 0.8 g of sodium polystyrene sulfonate as thickening agent were added thereto. The pH of the mixture was adjusted to 6.0 by using caustic soda.

Thus, the resulting emulsion was composed of monodispersed silver iodobromide octahedral grains, A-4 having an average particle size of 0.63 μm and a silver iodide content of 0.7 mol%.

The emulsions each was then subjected to optimum sulfur-gold sensitization by adding chloroaurate, sodium thiosulfate and ammonium thiocyanate to A-1, A-2, A-3 and A-4 each. Subsequently, the following amounts of sensitizing dyes (A) and (B) were added thereto each. Further, the emulsions each was stabilized by adding $2\times10^{-2}$ mol of 4-hydroxy-6-methyl-1,3,3a,7-tetrazaindene.

Sensitizing Dye (A)

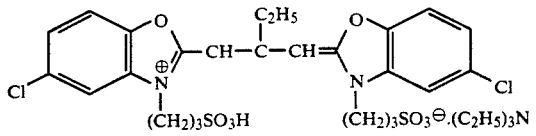

590 mg/Ag-mol

Sensitizing Dye (B)

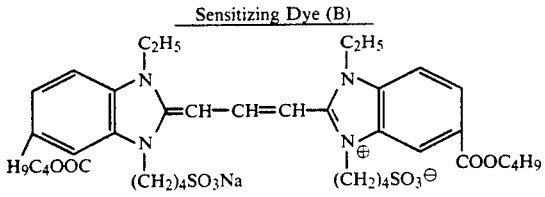

15 mg/Ag-mol

Preparation of Coating Solution for Emulsion Layer

The following reagents were added to the above emulsion A-1, A-2, A-3 or A-4, obtained by being subjected to the above chemical sensitization, in the amounts each per mol of silver halide as described below.

| | |
|---|---|
| 2,6-Bis (hydroxyamino)-4-diethylamino-1,3,5-triazine | 72 mg |
| Trimethylolpropane | 9 g |
| Dextran (average molecular weight: 39,000) | 18.5 g |
| Potassium polystyrenesulfonate (average molecular weight: 600,000) | 1.8 g |
| Gelatin | Such an amount as to provide the coated gelatin amount and swelling ratio given in Table 1. |
| Hardening agent | 1,2-Bis (vinylsulfonylacetamido) ethane such an amount as to provide the coated gelatin amount and swelling ratio given in Table 1. |

Preparation of Coating Solution for Surface Protective Layer

A surface protective layer was prepared to obtain such a coating composition as specified below for components each therein.

| Component in surface protective layer | Coated amount ($g/m^2$) |
|---|---|
| Gelatin | 0.966 |
| Sodium polyacrylate (average molecular weight: 400,000) | 0.023 |

-continued

| Component in surface protective layer | Coated amount ($g/m^2$) |
|---|---|
| 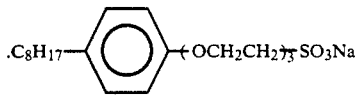 | 0.013 |
| $.C_{16}H_{33}O(CH_2CH_2O)_{10}-H$ | 0.045 |
| $.C_{17}H_{33}CON(CH_3)CH_2CH_2SO_3Na$ | 0.0065 |
| $.C_8F_{17}SO_2N(C_3H_7)(CH_2CH_2O)_{15}-H$ | 0.003 |
| $.C_8F_{17}SO_2N(C_3H_7)(CH_2CH_2O)_4(CH_2)_4SO_3Na$ | 0.001 |
| Polymethylmethacrylate (average particle size: 3.7 μm) | 0.087 |
| Proxel (pH: 7.4 adjusted with the use of NaOH) | 0.0005 |

Preparation of Photographic Material

A polyethyleneterephthalate support having a thickness of 183 μm and provided with a subbing layer containing beforehand a dye of the formula as shown below in an amount of 0.04% by weight was used.

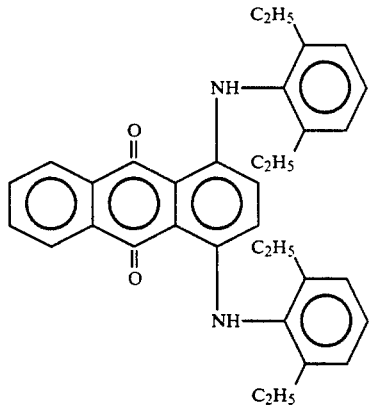

Both sides of the above transparent support were coated with the thus prepared coating solution for the emulsion layer and the thus prepared coating solution for the surface protective layer by means of a coextrusion method. The coated weight per one side was 1.7 $g/m^2$ as silver. Thus, photographic materials were obtained as set forth in Table 1.

Determination of Swelling Ratio

The swelling ratio of hydrophilic colloid layers of a photographic material was determined after a photographic material sample was allowed to stand for 7 days under the conditions of 25° C. and 60% RH. A dry thickness (a) of the layers of a sample was measured by testing a slice of the sample in a scanning electron microscope. The photographic material sample was immersed in distilled water at 21° C. for 3 minutes and subsequently it was freeze dried by liquid nitrogen. Then, the thus prepared specimen was tested in a scanning electron microscope to determine the swollen layers' thickness (b). Thus, the swelling ratio was obtained by the equation: (b)−(a)/(a)×100(%).

Evaluation of Photographic Performance

Each of photographic material samples 1 to 15 was exposed with blue light for 0.1 second from both sides thereof through a sharp cut filter SC 52 manufactured by Fuji Photo Film Co., Ltd. After the exposure, each exposed material sample was processed with a combination of the developing solution and fixing solution having the following compositions using an automatic processing machine. The sensitivity thereof was represented in terms of the reciprocal value of the ratio of an exposure amount giving a density of 1.0 to that of photographic material sample 1.

| Developing Solution Concentrate | |
|---|---|
| Potassium hydroxide | 56.6 g |
| Sodium sulfite | 200 g |
| Diethylenetriaminepentaacetic acid | 6.7 g |
| Potassium carbonate | 16.7 g |
| Boric acid | 10 g |
| Hydroquinone | 83.3 g |
| Diethyleneglycol | 40 g |
| 4-Hydroxymethyl-4-methyl-1-phenyl-3-pyrazolidone | 22.0 g |
| 5-Methylbenztriazole | 2 g |
| Water to make (pH adjusted to 10.60) | 1 liter |
| **Fixing Solution Concentrate** | |
| Ammonium thiosulfate | 560 g |
| Sodium sulfite | 60 g |
| Disodium ethylenediamine-tetraacetate dihydrate | 0.10 g |
| Sodium hydroxide | 24 g |
| Water to make (pH adjusted to 5.10 with the use of acetic acid) | 1 liter |

The tanks of an automatic processing machine each was filled with the processing solutions of the following compositions each when the processing was started.

Developing tank: added to 333 ml of the above-described developing solution concentrate were 667 ml of water and 10 ml of a starter solution containing 2 g of potassium bromide and 1.8 g of acetic acid to adjust the pH to 10.25.

Fixing tank: added to 200 ml of the above-described fixing solution concentrate was 800 ml of water.

As an automatic processing machine, FPM 9000 was converted wherein a film could be carried at a higher speed so that a Dry to Dry processing time was made in 30 seconds. Rinsing water was allowed to run at a rate of 3 liters per minute while the film was being carried, except for that period it was stopped.

Replenishing a developing solution and fixing solution was carried out in such a manner as shown below and also the processing each was effected at the following temperature:

| Processing Step | Temperature | Replenishing Solution |
|---|---|---|
| Development | 35° C. | 20 ml/10 × 12 inch |
| Fixing | 32° C. | 30 ml/10 × 12 inch |
| Washing | 20° C. | 3 l/minute |
| Drying | 55° C. | |

Evaluation of Roller Mark

Each of photographic material Samples 1 to 15 in size of 10×12 inch was so exposed uniformly as to give the density of 1.0 and then was processed under the same conditions as those of the evaluation of photographic performances, excepting that well worn-out rollers were used herein for both the carrying roller in developing tank and the crossover roller from developing to fixing. The unevenness on the surface of the rollers was present to such an extent as ±10 μm in size. Many fine spots on the samples processed due to the above unevenness on the surface of the rollers were obtained, with the degree of the spots produced depending on the kind of the photographic material samples. According to the above degree the samples were sensory-evaluated by classifying them into 4 levels as described below. The results obtained are shown in Table 1 as follows:

| | |
|---|---|
| ◎ | Few spots were developed. |
| ○ | Slight spots were developed but practically on a negligible level. |
| Δ | Spots were developed which were normally undeveloped on the ordinary rollers. They were, however, on the permissible level. |
| x | Spots were developed frequently, which could not stand the use even on the ordinary rollers. |

Evaluation of Dryness

Each film of photographic material samples in the film size of 10×12 inch was processed continuously under the same conditions as those of the evaluation of photographic performances and the dryness of the thus processed film was evaluated with tactile distinction below. The film was processed continuously in such a direction that the film was carried in parallel with its shorter side. The results obtained are shown in Table 1 below.

| | |
|---|---|
| ⓒ | Even the 30th sheet was produced in the state of warm and dried film such that it could be on a satisfactory level. |
| ○ | Even the 30th sheet was produced in the state of completely dried film such that its temperature on being touched was on the same level as that of a film which had been stored at room temperature. |
| Δ | The 30th sheet was produced in the state of relatively cold film such that the continuously processed film was not stuck on the surface and so practically on the the permissible level. |
| X | The 30th sheet was produced in the state of wet and undried film such that the films were stuck to each other on the surfaces. |

Evaluation of Fixability

Each of photographic material samples, as unexposed, was processed under the above-described conditions by an automatic processing machine and then the thus processed sample was observed visually under fluorescent light to see whether or not the fixing was done throughout. When the photographic material sample had a slightly cloudy portion, fixability was judged poor. It should be understood that, even if there exists no problem for a sample in view of the result of the evaluation test, it still may be possible to introduce a problem in image preservability due to residual silver and residual hypo present therein.

The results obtained are shown in Table 1 below.

TABLE 1

| Photographic Material Sample | Emulsion | Silver Iodide Content (mol %/Ag) | Coated Gelatin Per one Side Amount ($g/m^2$) | Swelling Ratio (%) | Relative Sensitivity | Dryness | Roller Mark | Fixability |
|---|---|---|---|---|---|---|---|---|
| (Comparison) 1 | A-1 | 0 | 2.15 | 230 | 100 | ○ | ◎ | good |
| (Invention) 2 | A-2 | 0.1 | " | " | 165 | ○ | ○ | " |
| (Invention) 3 | A-3 | 0.5 | " | " | 175 | ○ | Δ | " |
| (Comparison) 4 | A-4 | 0.7 | " | " | 175 | ○ | X | " |
| (Comparison) 5 | A-2 | 0.1 | 2.7 | " | 155 | X | ◎ | " |
| (Invention) 6 | " | " | 2.4 | " | 160 | Δ | ◎ | " |
| (Invention) 7 | " | " | 2.0 | " | 165 | ○ | ○ | " |
| (Invention) 8 | " | " | 1.8 | " | 170 | ◎ | Δ | " |
| (Comparison) 9 | " | " | 1.5 | " | 180 | ◎ | X | " |
| (Invention) 10 | " | 0.5 | 2.4 | 290 | 180 | Δ | Δ | " |
| (Invention) 11 | " | " | " | 260 | 170 | Δ~○ | Δ~○ | " |
| (Invention) 12 | " | " | " | 210 | 165 | ○ | ○ | " |
| (Invention) 13 | " | " | " | 180 | 155 | ◎ | ◎ | " |
| (Comparison) 14 | " | " | 2.7 | 200 | 160 | X~Δ | ◎ | poor |
| (Comparison) 15 | " | " | " | 180 | 150 | Δ | ◎ | " |

*Note: The amount of the gelatin present in the surface protective layer was 0.966 $g/m^2$ among the amount of the gelatin coated per one side.

As seen from comparisons of the results of photographic material samples 1 to 4 shown in Table 1, it was found that the silver iodide content in an emulsion layer had a large effect on the level evaluated of roller mark such that photographic material sample 4 having a silver iodide content of 0.7 mol% per silver showed the practically unpermissible level; however, photographic material sample 1 having no silver iodide suffered from a large decrease in sensitivity, thus failing to achieve the high sensitivity as one of the objects of the present invention.

When comparisons were made of the results of photographic material samples 5 to 9 and 2, it was found photographic material sample 5 having an amount of gelatin coated of 2.7 $g/m^2$ showed a large decrease in sensitivity, providing a problem in dryness; however, photographic material sample having the amount of gelatin coated of 1.5 $g/m^2$ indicated a problem in roller mark. From these results above the effects of the present invention is understood to be apparent.

Furthermore, photographic material samples 14 and 15 were intended to make an improvement in dryness with an increase in the amount of a hardening agent used; however, the samples were found to be poor in fixing. In addition, the soft film such as photographic material sample 10 showed an increase in sensitivity and permissible levels in dryness and roller mark; however, it was not most suitable.

EXAMPLE 2

Preparation of Tabular Grain T-1 for the Present Invention

Added to a solution of 4.5 g of potassium bromide, 20.6 g of gelatin and 2.5 ml of a 5% aqueous solution of a thioether of formula: $HO(CH_2)_2S(CH_2)_2S\text{-}(CH_2)_2OH$ in one liter of water, keeping the solution at a temperature of 60° C. with stirring, were 37 ml of an aqueous solution of 3.43 g of silver nitrate and 33 ml of an aqueous solution containing 2.97 g of potassium bromide and 0.363 g of potassium iodide over a period of 37 seconds by a double jet process. Subsequently, added thereto was an aqueous solution of 0.9 g of potassium iodide and then the temperature of the mixture was raised to 70° C. Further, added thereto was 53 ml of an aqueous solution of 4.90 g of silver nitrate over a period of 13 minutes. Then, added thereto were 15 ml of an aqueous solution of 25% ammonia and, keeping the temperature as such, the mixture was subjected to physical ripening. Thereafter, added thereto was 14 ml of a 100% acetic acid solution. Subsequently, an aqueous solution of 133.3 g of silver nitrate and an aqueous solution of potassium bromide were added thereto keeping the system at a pAg of 8.5 by a controlled double jet process over a period of 35 minutes. Then, added thereto were 10 ml of a 2N potassium thiocyanate solution and AgI fine grains having a diameter of 0.07 μm in an amount of 0.05 mol% of the total amount of silver. The mixture then was subjected to physical ripening keeping the temperature as such over a period of 5 minutes and further the temperature of the mixture was lowered to 35° C. The thus obtained monodispersed tabular grains had a total silver iodide content of 0.31 mol%, an average diameter of projected area of 1.10 μm, a thickness of 0.165 μm and a deviation coefficient of diameter of 18.5%.

Thereafter, solution salts were removed by a precipitation method. The temperature thereof was again raised to 40° C. and then 30 g of gelatin, 2.35 g of phenoxyethanol and 0.8 g of sodium polystyrenesulfonate as a thickening agent were added thereto. The pH of the mixture was adjusted to 5.90 by using soda, while the pAg thereof was adjusted to 8.25 by using a solution of silver nitrate.

The resulting emulsion was subjected to chemical sensitization keeping it at a temperature of 56° C. with stirring. To begin with, the emulsion underwent reduction sensitization, with 0.043 mg of thiourea dioxide being added, leaving the emulsion as it is for a period of 22 minutes. Subsequently, added thereto were 20 mg of 4-hydroxy-6-methyl-1,3,3a,7-tetrazaindene and 500 mg of sensitizing dye (A) as used in Example 1. Furthermore, added thereto was 1.1 g of an aqueous solution of calcium chloride, followed by the addition of 3.3 mg of sodium sulfate, 2.6 mg of chloroauric acid and 90 mg of potassium thiocyanate. Also, 40 minutes thereafter the mixture was cooled to 35° C. Thus, the preparation of tabular grain T-1 of the present invention went to completion.

Preparation of Tabular Grain T-2 for the Present Invention

Added to a solution of 4.5 g of potassium bromide, 20.6 g of gelatin and 2.5 ml of a 5% aqueous solution of a thioether of formula: $HO(CH_2)_2S(CH_2)_2S\text{-}(CH_2)_2OH$ in one liter of water, keeping the solution at a temperature of 60° C. with stirring, were 37 ml of an aqueous solution of 3.43 g of silver nitrate and 33 ml of an aqueous solution containing 2.97 g of potassium bromide and 0.363 g of potassium iodide over a period of 37 seconds by a double jet process. Subsequently, added thereto was an aqueous solution of 0.9 g of potassium iodide and then the temperature of the mixture was raised to 70° C. Further, added thereto was 53 ml of an aqueous solution of 4.90 g of silver nitrate over a period of 13 minutes. Then added thereto were 15 ml of an aqueous solution of 25% ammonia and, keeping the temperature thereof as such before, the mixture was subjected to physical ripening. Thereafter, added thereto was 14 ml of a 100% acetic acid solution. (So far the procedure in the process was the same as that of T-1 as above.)

Subsequently, added thereto were an aqueous solution of 133.3 g of silver nitrate and an aqueous solution of a mixture of potassium bromide and potassium iodide keeping the mixture at a pAg of 8.1 by a controlled double jet process over a period of 35 minutes. The amount of potassium iodide consumed herein reached 0.2 mol% of the total amount of silver present in the end grains.

Then, added thereto were 10 ml of a 2N potassium thiocyanate solution and AgI fine grains having a diameter of 0.07 μm in an amount of 0.05 mol% of the total amount of silver. The mixture then was subjected to physical ripening keeping the temperature as such over a period of 5 minutes and further the temperature of the mixture was lowered to 35° C. Thus, monodispersed tabular grains were obtained which had a total silver iodide content of 0.51 mol%, an average diameter of projected area of 1.15 μm, a thickness of 0.162 μm and a deviation coefficient of diameter of 20.5%.

Thereafter, soluble salts were removed by a precipitation method. the temperature thereof was again raised to 40° C. and then 30 g of gelatin, 2.35 g of phenoxyethanol and 0.8 g of sodium polystyrenesulfonate as a thickening agent were added thereto. The pH of the mixture was adjusted to 5.90 by using caustic soda, while the pAg thereof was adjusted to 8.25 by using a solution of silver nitrate.

The resulting emulsion was subjected to chemical sensitization keeping it at a temperature of 56° C. with stirring. To begin with, the emulsion underwent reduction sensitization, with 0.043 mg of thiourea dioxide being added, leaving the emulsion as it is for a period of 22 minutes. Subsequently, added thereto were 20 mg of 4-hydroxy-6-methyl-1,3,3a,7-tetrazaindeve and 500 mg of sensitizing dye (A) as used in Example 1. Furthermore, added thereto was 1.1 g of an aqueous solution of calcium chloride, followed by the addition of 3.3 mg of sodium thiosulfate, 2.6 mg of chloroauric acid and 90 mg of potassium thiocyanate. Also, 40 minutes thereafter the mixture was cooled to 35° C. Thus, the preparation of tabular grains T-2 of the present invention went to completion.

Preparation of Tabular Grain T-3 for Comparative Example

Grains herein were obtained in the same manner as those in T-2 except that AgI fine grains having a diameter of 0.07 μm as used in T-2 were added in an amount of 0.2 mol% of the total amount of silver, thereby forming mono-dispersed tabular grains having a total silver iodide content of 0.66 mol%.

Preparation of Coating Solution Sample

The following reagents were added to the above grains from T-1 to T-3 in the amounts each per mol of silver halide as described below.

| | |
|---|---|
| 2,6-Bis (hydroxyamino)-4-diethylamino-1,3,5-triazine | 72 mg |
| Gelatin | |
| To add such an amount that the sum of the amount added herein and the amount for use in surface protective layer as described below results in the total amount of coated gelatin shown in Table 2. | |
| Trimethylol propane | 9 g |
| Dextran (average molecular weight: 39,000) | 18.5 g |
| Sodium polystyrenesulfonate (average molecular weight: 600,000) | 1.8 g |
| Hardneing agent | |
| 1,2-Bis(vinylsulfonylacetamido)ethan such an amount as to provide the swelling ratio given in Table 2. | |
| 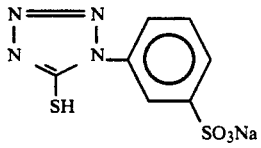 | 34 mg |
| 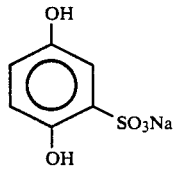 | 10.9 g |

Preparation of Coating Solution for Surface Protective Layer

A surface protective layer was prepared to obtain such a coating composition as specified below for components each therein.

| Component in surface protective layer | Coated amount ($g/m^2$) |
|---|---|
| Gelatin | 0.966 |
| Sodium polyacrylate (average molecular weight: 400,000) | 0.023 |
| 4-Hydroxy-6-methyl-1,3,3a,7-tetrazaindene | 0.015 |
| $C_8H_{17}$–(C6H4)–$(OCH_2CH_2)_{13}SO_3Na$ | 0.013 |
| $C_{16}H_{33}O(CH_2CH_2O)_{10}H$ | 0.045 |
| $C_{17}H_{33}CON(CH_3)CH_2CH_2SO_3Na$ | 0.0065 |
| $C_8F_{17}SO_2N(C_3H_7)(CH_2CH_2O)_{15}H$ | 0.003 |
| $C_8F_{17}SO_2N(C_3H_7)(CH_2CH_2O)_4(CH_2)_4SO_3Na$ | 0.001 |
| Polymethyl methacrylate (average particle size: 3.7 μm) | 0.087 |
| Proxel (pH: 7.4 adjusted with the use of NaOH) | 0.0005 |

Preparation of Support (1) Preparation of Dye D-1 for Subbing Layer

The dye given below was subjected to ball-milling as described in JP-A-63-197943.

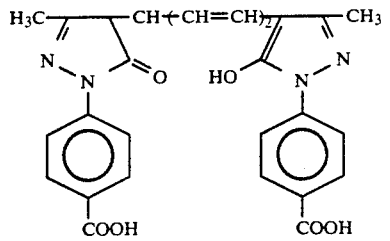

Charged to a ball mill having a volume of 2 liters was 434 ml of water and 791 ml of a 6.7% aqueous solution of Triton X-200® surface active agent (TX-200®). Added to the resulting solution was 20 g of the dye. Further, added thereto was 400 ml of zirconium oxide (ZrO) beads (having a diameter of 2 mm) and then the mixture was subjected to grinding in a mill over a period of 4 days. Subsequently, added thereto was 160 g of 12.5% gelatin. After defoaming, the zirconium oxide beads were removed to obtain a dye dispersion. The dye grains obtained in the dispersion had a broad distribution of particle diameter of from 0.05 to 1.15 μm with an average grain size of 0.37 μm. The mixture was subjected to centrifugation to remove the dye grains having a size of not less than 0.9 μm, thereby obtaining dye dispersion D-1.

(2) Preparation of Support

A biaxially stretched polyethylene terephthalate film of 183 μm in thickness was subjected to a corona discharge treatment and was coated with the following first subbing solution having the composition given below by means of wire bar coater in such an amount as to give a coating level of 5.1 cc/m². The coated film was dried at 175° C. for one minute.

In the same way as the above coating, the other side of the film was coated therewith to form the first subbing layer. The polyethylene terephthalate containing a dye of the formula given below in an amount of 0.04% by weight was used.

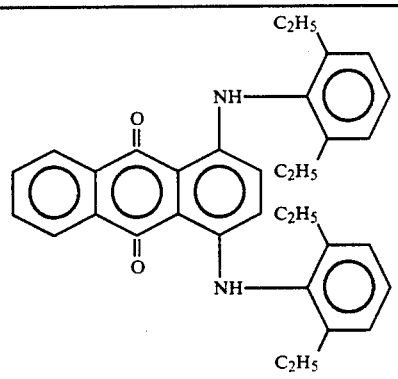

| | |
|---|---|
| Butadiene-styrene copolymer latex solution (solid: 40%, butadiene/styrene = 31/69 by weight) | 79 ml |
| 4% Solution of sodium salt of 2,4-dichloro-6-hydroxy-s-triazine | 20.5 ml |
| Distilled water | 900.5 ml |

-continued

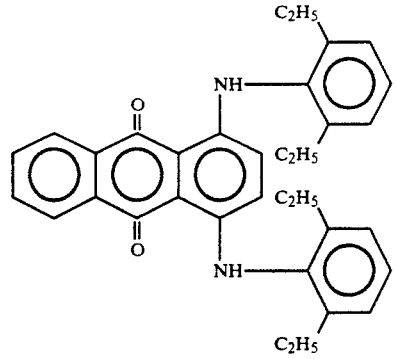

Note: The latex solution contained 0.4% by weight, based on the amount of latex, on a solid basis, of a component represented by the following formula as an emulsifying dispersant:

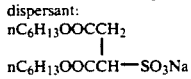

Both sides of the film having the first subbing layer thereon were coated with the following second subbing solution having the following composition in such a coating amount as given below, side by side by means of wire bar coater and was dried at 150° C.

| | |
|---|---|
| Gelatin | 160 mg/m² |
| Dye dispersion D-1 (26 mg/m² on a solid basis of dye) | |
| 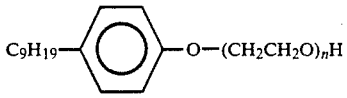 (n = 8,5) | 8 mg/m² |
| 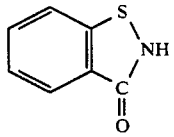 | 0.27 mg/m² |
| Matting agent: polymethyl methacrylate having an average particle size of 2.5 μm | 2.5 mg/m² |

Preparation of Photographic Material

Both sides of the thus prepared support were coated with the coating solution for the emulsion layer and surface protective layer as described above by means of a co-extrusion method. The coated silver amount per one side was 1.75 g/m². A swelling ratio determined by free-drying was altered by controlling the amount of gelatin coated and the amount of hardening agent used such that the swelling ratio was set for as given in Table 2. Thus, photographic material samples 16 to 24 were obtained.

Evaluation of Photographic Performance

Each of photographic material samples 101 and 301 to 306 was exposed to light from both sides thereof for 0.05 second using X-ray orthoscreen HR-4 manufactured by Fuji Photo Film Co., Ltd. to carry out the evaluation of sensitivity. After the exposure, each exposed sample was processed as described below. The sensitivity thereof was represented in terms of the reciprocal value of the ratio of an exposure amount giving a density of 1.0 to that of photographic material sample 1.

| | |
|---|---|
| Processing I | |
| Automatic processing machine | SRX-501 manufactured by KONICA Co., Ltd. |
| Developer | RD-3 manufactured by Fuji Photo Film Co., Ltd. |
| Fixer | Fuji F manufactured by Fuji Photo Film Co., Ltd. |
| Processing speed | Dry to Dry 90 seconds |
| Development temperature | 35° C. |
| Fixing temperature | 32° C. |
| Drying temperature | 45° C. |
| Replenishment amount | Developer: 22 ml/10 × 12 inch<br>Fixer: 30 ml/10 × 12 inch |
| Processing II | |
| Automatic processing machine | SRX-501 manufactured by KONICA Co., Ltd. wherein driving motor and gear were refined to enhance carrying speed. |
| Developer and Fixer: | |
| Developing Solution Concentrate | |
| Potassium hydroxide | 56.6 g |
| Sodium sulfite | 200 g |
| Diethylenetriaminepentaacetic acid | 6.7 g |
| Potassium carbonate | 16.7 g |
| Boric acid | 10 g |
| Hydroquinone | 83.3 g |
| Diethylene glycol | 40 g |
| 4-Hydroxymethyl-4-methyl-1-phenyl-3-pyrazolidone | 22.0 g |
| 5-Methylbenztriazole | 2 g |
| 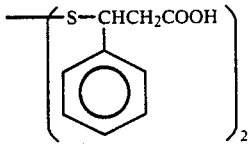 | 0.6 g |
| Water to make (pH adjusted to 10.60) | 1 liter |
| Fixing Solution Concentrate | |
| Ammonium thiosulfate | 560 g |
| Sodium sulfite | 60 g |

-continued

| | |
|---|---|
| Disodium ethylene diamine tetraacetate dihydrate | 0.10 g |
| Sodium hydroxide | 24 g |
| Water to make (pH adjusted to 5.10 with the use of acetic acid) | 1 liter |

The tanks of an automatic processing machine each was filled with the processing solutions of the following compositions each when the processing was started.

| | |
|---|---|
| Developing tank: | Added to 333 ml of the above-described developing solution concentrate and 667 ml of water was 10 ml of a starter solution containing 2 g of potassium bromide and 1.8 g of acetic acid to adjust the pH to 10.25. |
| Fixing tank: | Added to 200 ml of the above-described fixing solution concentrate was 800 ml of water. |
| Processing speed | Dry to Dry 30 seconds |
| Development temperature | 35° C. |
| Fixing temperature | 32° C. |
| Drying temperature | 55° C. |
| Replenishment amount | |
| Developer: | 22 ml/10 × 12 inch |
| Fixer: | 30 ml/10 × 12 inch |

Evaluation of Dryness

When processing II was performed, the dryness of film was evaluated on the same basis as in Example 1.

Evaluation of Roller Mark

Each of photographic materials was evaluated in the same manner as in Example 1.

Evaluation of Residual Dye

When processing II was performed, the residual dye of film was evaluated based on the visual comparison of the thus obtained film in processing II with that in processing I.

The results obtained are shown in Table 2.

TABLE 2

| Photographic Material Sample | Emulsion | Silver Iodide Content (mol %/Ag) | Coated Gelatin Per one Side Amount (g/m²) | Swelling Ratio (%) | Relative Sensitivity Processing I | Relative Sensitivity Processing II | Dryness | Roller Mark | Residual Dye |
|---|---|---|---|---|---|---|---|---|---|
| (Comparison) 1 | A-1 | 0 | 2.15 | 230 | 100 | 85 | ○ | ◎ | good |
| (Invention) 3 | A-3 | 0.5 | " | " | 180 | 160 | ○ | Δ | " |
| (Invention) 16 | T-1 | 0.31 | " | " | 310 | 310 | ○ | ○ | " |
| (Invention) 17 | T-2 | 0.51 | " | " | 315 | 310 | ○ | ○ | " |
| (Comparison) 18 | T-3 | 0.66 | " | " | 310 | 290 | ○ | X | " |
| (Comparison) 19 | T-1 | 0.31 | 2.7 | " | 265 | 240 | X | ◎ | " |
| (Invention) 20 | " | " | 2.4 | " | 290 | 270 | Δ | ◎ | " |
| (Invention) 21 | " | " | 1.8 | " | 340 | 340 | ◎ | Δ | " |
| (Comparison) 22 | " | " | 1.5 | " | 380 | 385 | ◎ | X | " |
| (Comparison) 23 | T-2 | 0.51 | 2.7 | 200 | 250 | 220 | Δ | ◎ | poor |
| (Comparison) 24 | " | " | " | 180 | 220 | 180 | ○ | ◎ | " |

Comparing the results of photographic material samples 16 to 18, it was found that roller mark was improved when a silver iodide content was not more than 0.6 mol% in tabular grains. Photographic samples 16 and 17 for the present invention were very high in sensitivity by comparison with photographic samples 1 and 3 in Example 1; therefore, it was obvious that the effect of tabular grains was large. Also, from comparisons of the results of the sensitivity between processing I and processing II, it was found that octahedral grains were higher in sensitivity with processing II, a super rapid processing, than those with processing I. There was little difference in sensitivity for tabular grains between photographic material samples 16 and 17.

When comparisons were made of the results of photographic material samples 19 to 22, it was observed that, with an increase in the amount of gelatin coated, dryness turned out to be below permissible levels, thus resulting in a large decrease in sensitivity. Photographic material sample 22 having 1.5 g/m$^2$ of gelatin dropped below permissible levels in roller mark.

Photographic material samples 23 and 24 were intended for confirming the effect of the addition of a hardening agent in an amount sufficient to obtain the reduced swelling ratio below 200% as described in JP-A-58-111933. Although it was confirmed as described therein that, even if the reduced swelling ratio was obtained, the covering power of photographic material samples 23 and 24 was high and an improvement in dryness due to hardening was made, the disadvantages still remained in that, with the reduced swelling ratio being obtained, fixability and residual dye turned out to be worse, thus resulting in the practically unusable level thereof. Further, there were disadvantages in that, with the reduced swelling ratio being obtained, a large decrease in deterioration of photographic performance was observed, particularly in the super rapid processing such as processing II.

While the invention has been described in detail and with reference to specific embodiments thereof, it will be apparent to one skilled in the art that various changes and modifications can be made therein without departing from the spirit and scope thereof.

What is claimed is:

1. A silver halide photographic light-sensitive material comprising a transparent support having coated thereon gelatin in a total coating amount of 1.7–2.5 g/m$^2$ per one side of the support and one or more hydrophilic colloid layers at least one of which is a photosensitive layer containing photosensitive silver halide grains, said silver halide grains being silver iodobromide having a silver iodide content from 0.01 to 0.4 mol% and a swelling ratio determined by free-drying of said hydrophilic colloid layer or layers being 200–280%.

2. The silver halide photographic light-sensitive material of claim 1, wherein at least 70% of said silver halide grains expressed in terms of a projected area are tabular grains having an aspect ratio of 3 or more.

* * * * *